US008952860B2

(12) United States Patent
Li et al.

(10) Patent No.: US 8,952,860 B2
(45) Date of Patent: Feb. 10, 2015

(54) ANTENNA STRUCTURES WITH CARRIERS AND SHIELDS

(75) Inventors: Qingxiang Li, Mountain View, CA (US); Robert W. Schlub, Cupertino, CA (US); Jonathan Hayes, Los Gatos, CA (US); Enrique Ayala Vazquez, Watsonville, CA (US); Yingmeng Wu, Fremont, CA (US)

(73) Assignee: Apple Inc., Cupertino, CA (US)

( * ) Notice: Subject to any disclaimer, the term of this patent is extended or adjusted under 35 U.S.C. 154(b) by 830 days.

(21) Appl. No.: 13/038,169

(22) Filed: Mar. 1, 2011

(65) Prior Publication Data

US 2012/0223865 A1 Sep. 6, 2012

(51) Int. Cl.
*H01Q 1/52* (2006.01)
*H01Q 1/24* (2006.01)
*H01Q 9/42* (2006.01)

(52) U.S. Cl.
CPC . *H01Q 1/243* (2013.01); *H01Q 9/42* (2013.01)
USPC ..... 343/841; 343/702

(58) Field of Classification Search
CPC ..... H01Q 1/241; H01Q 1/242; H01Q 1/243; H01Q 1/24; H01Q 1/52; H01Q 1/526
USPC ..... 343/702, 841, 872
See application file for complete search history.

(56) References Cited

U.S. PATENT DOCUMENTS 4,016,490 A 4/1977 Weckenmann et al.
4,614,937 A 9/1986 Poujois
5,337,353 A 8/1994 Boie et al.
5,650,597 A 7/1997 Redmayne
5,864,316 A 1/1999 Bradley et al.
6,285,324 B1 9/2001 Korisch et al.
6,329,958 B1 12/2001 McLean et al.
6,380,899 B1 4/2002 Madsen et al.
6,590,539 B2 7/2003 shinichi
6,879,293 B2 4/2005 Sato (Continued)

FOREIGN PATENT DOCUMENTS

DE 10035935 1/2002
EP 0564164 10/1993

(Continued)

OTHER PUBLICATIONS

Pance, Aleksander, et al. U.S. Appl. No. 12/861,640, filed Aug. 23, 2010.

*Primary Examiner* — Robert Karacsony
(74) *Attorney, Agent, or Firm* — Treyz Law Group; G. Victor Treyz; Michael H. Lyons

(57) ABSTRACT

Antennas are provided for electronic devices such as portable computers. An electronic device may have a housing in which an antenna is mounted. The housing may be formed of conductive materials. A dielectric window may be mounted in the housing to allow radio-frequency signals to be transmitted from the antenna and to allow the antenna to receive radio-frequency signals. A proximity sensor adjacent to the dielectric window may be used in detecting external objects. The antenna may have an antenna resonating element that is mounted against an inner surface of a display cover glass layer. The antenna resonating element may be mounted to an upper surface of a plastic carrier. An electromagnetic shield may be mounted on a lower surface of the plastic carrier above the proximity sensor.

20 Claims, 6 Drawing Sheets

(56) References Cited

U.S. PATENT DOCUMENTS

| | | | |
|---|---|---|---|
| 6,963,308 | B2 | 11/2005 | Korva |
| 7,146,139 | B2 | 12/2006 | Nevermann |
| 7,242,354 | B2 | 7/2007 | Katoh et al. |
| 7,804,453 | B2 | 9/2010 | Chiang et al. |
| 7,843,396 | B2 | 11/2010 | Hill et al. |
| 8,432,322 | B2 | 4/2013 | Amm et al. |
| 8,466,839 | B2 | 6/2013 | Schlub et al. |
| 8,517,383 | B2 | 8/2013 | Wallace et al. |
| 2003/0210203 | A1 | 11/2003 | Phillips et al. |
| 2004/0201528 | A1 | 10/2004 | Lee et al. |
| 2006/0161871 | A1 | 7/2006 | Hotelling et al. |
| 2006/0244663 | A1 | 11/2006 | Fleck et al. |
| 2006/0274493 | A1 | 12/2006 | Richardson et al. |
| 2006/0278444 | A1 | 12/2006 | Binstead |
| 2007/0262909 | A1 | 11/2007 | Chang et al. |
| 2008/0246735 | A1 | 10/2008 | Reynolds et al. |
| 2008/0316120 | A1 | 12/2008 | Hirota et al. |
| 2008/0316121 | A1 | 12/2008 | Hobson et al. |
| 2009/0040115 | A1 | 2/2009 | Zhang et al. |
| 2009/0096683 | A1 | 4/2009 | Rosenblatt et al. |
| 2009/0174611 | A1 | 7/2009 | Schlub et al. |
| 2009/0295648 | A1 | 12/2009 | Dorsey et al. |
| 2010/0103116 | A1 | 4/2010 | Leung et al. |
| 2010/0253651 | A1 | 10/2010 | Day |
| 2011/0012793 | A1 | 1/2011 | Amm et al. |
| 2011/0012794 | A1 | 1/2011 | Schlub et al. |
| 2012/0194393 | A1* | 8/2012 | Uttermann et al. ..... 343/702 |
| 2012/0223866 | A1 | 9/2012 | Vazquez et al. |

FOREIGN PATENT DOCUMENTS

| | | |
|---|---|---|
| EP | 1324425 | 7/2003 |
| EP | 1469550 | 10/2004 |
| JP | 2004005516 | 1/2004 |
| JP | 2008046070 | 2/2008 |
| JP | 2009032570 | 2/2009 |
| WO | 02078123 | 10/2002 |
| WO | 2008078142 | 7/2008 |
| WO | 2010123733 | 10/2010 |

* cited by examiner

ANTENNA STRUCTURES WITH CARRIERS AND SHIELDS

BACKGROUND

This relates generally to antennas, and, more particularly, to antennas for electronic devices.

Electronic devices such as portable computers and handheld electronic devices are becoming increasingly popular. Devices such as these are often provided with wireless communications capabilities. For example, electronic devices may use long-range wireless communications circuitry such as cellular telephone circuitry and short-range communications circuitry such as wireless local area network communications circuitry. Some devices are provided with the ability to receive other wireless signals such as Global Positioning System signals.

It can be difficult to incorporate antennas successfully into an electronic device. Some electronic devices are manufactured with small form factors, so space for antennas is limited. In many electronic devices, the presence of electronic components in the vicinity of an antenna serves as a possible source of electromagnetic interference. Antenna operation can also be disrupted by nearby conductive structures. Considerations such as these can make it difficult to implement an antenna in an electronic device that contains conductive housing walls or other conductive structures that can potentially block radio-frequency signals.

It would therefore be desirable to be able to provide improved antennas for wireless electronic devices.

SUMMARY

Antennas may be provided for electronic devices such as portable computers. An antenna may have an antenna resonating element that is mounted against an inner surface of a display cover glass layer in an electronic device. The electronic device may have a housing formed of conductive materials. A dielectric window may be mounted in the housing to allow radio-frequency signals to be transmitted from the antenna and to allow the antenna to receive radio-frequency signals.

A capacitor electrode for a proximity sensor may be mounted in the vicinity of the antenna. For example, a capacitive proximity sensor electrode may be mounted adjacent to the dielectric window and may be used in detecting external objects. Proximity sensor measurements may be used in establishing limits on transmitted radio-frequency power.

The antenna resonating element may be mounted to an upper surface of a plastic carrier. An electromagnetic shield may be mounted on a lower surface of the plastic carrier above the proximity sensor. The electromagnetic shield may be interposed between the capacitor electrode and the antenna resonating element to shield the antenna resonating element from the capacitor electrode.

Further features of the invention, its nature and various advantages will be more apparent from the accompanying drawings and the following detailed description of the preferred embodiments.

DETAILED DESCRIPTION

Figure 1:
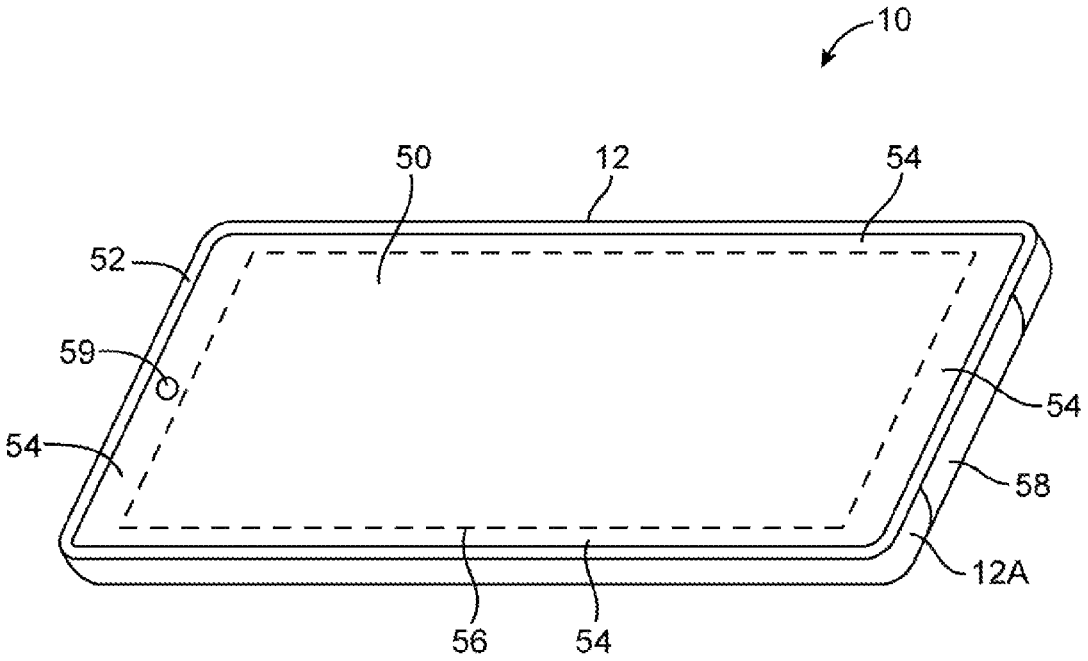
FIG. 1 is a front perspective view of an illustrative electronic device with an antenna having a dielectric carrier member and a shield in accordance with an embodiment of the present invention.

Electronic devices may be provided with wireless communications circuitry. The wireless communications circuitry may be used to support wireless communications in one or more wireless communications bands. For example, the wireless communications circuitry may transmit and receive signals in cellular telephone bands and other communications bands.

To satisfy consumer demand for small form factor wireless devices, manufacturers are continually striving to reduce the size of components that are used in these devices while providing enhanced functionality. Particularly in configurations in which an electronic device is used in transmitting and receiving radio-frequency signals in cellular telephone bands and other communications bands that have relatively wide bandwidths, it can be challenging to meet desired antenna performance criteria in a compact device. High transmit powers and wide antenna bandwidths can be desirable to ensure adequate signal strength during communications, but these attributes may give rise to challenges with controlling emitted radiation levels.

It is generally impractical to completely shield a user of an electronic device from transmitted radio-frequency signals. For example, conventional cellular telephone handsets generally emit signals in the vicinity of a user's head during telephone calls. Government regulations limit radio-frequency signal powers. For example, specific absorption rate (SAR) standards are in place in many jurisdictions that impose maximum energy absorption limits on handset manufacturers. At the same time, wireless carriers require that the user equipment that is used in their networks be capable of producing certain minimum radio-frequency powers so as to ensure satisfactory operation of the equipment.

One way to satisfy the demands of wireless carriers while complying with SAR standards involves use of proximity sensors to detect when an external object is in the presence of an antenna in an electronic device. When no external objects are present, the antenna can be operated over its full range of operating powers. When external objects are present, the maximum allowed transmit power for the antenna can be temporarily reduced to ensure that SAR limits are satisfied.

Space is at a premium in portable electronic devices and housings for these devices are sometimes constructed from conductive materials that block antenna signals. Arrangements in which antenna structures are formed behind an antenna window can help address these challenges. Antenna windows may be formed in conductive housing walls by forming a dielectric antenna window structure within an opening in the conductive housing wall. If desired, wireless signals can also be accommodate by forming all or most of the electronic device housing from a dielectric such as plastic. In some configurations, wireless signals can pass through dielectric structures such as the cover glass layers associated with a display. These configurations, other configurations for accommodating wireless signals in a device, or combinations of these configurations may be used in a wireless electronic device if desired.

An antenna resonating element for an antenna may be formed in the vicinity of an antenna window or under a portion of a display cover layer. Portions of the conductive housing or other conductive structures may serve as antenna ground. The antenna can be fed using a positive antenna feed terminal that is coupled to the antenna resonating element and a ground antenna feed terminal that is coupled to the conductive housing. During operation, radio-frequency signals for the antenna can pass through the antenna window or other non-conducting housing structures (e.g., part of the cover glass).

A proximity-based antenna power control circuit may be used to reduce near-field electromagnetic radiation intensities when the presence of an external object is detected in the vicinity of the antenna. The proximity-based antenna power control circuit may be based on a capacitive proximity sensor. Sensor electrodes for the capacitive proximity sensor may be placed in the vicinity of the antenna.

The antenna may be formed from an antenna resonating element and conductive portions of the housing or other conductive structures that serve as antenna ground. The antenna resonating element may be formed from conductive traces on a dielectric substrate. The conductive traces may be formed from copper or other metals. The dielectric substrate may be, for example, a rigid printed circuit board or a flexible printed circuit. Flexible printed circuits, which are sometimes referred to as flex circuits, have conductive traces formed on a flexible dielectric substrate such as sheets of polyimide or other polymers.

An antenna resonating element substrate may be mounted on a support structure. For example, an antenna resonating element substrate may be mounted on a dielectric carrier such as a molded plastic carrier.

The antenna resonating element and carrier may be mounted in the electronic device so that antenna signals can pass through the cover glass or other dielectric portions of the housing such as a dielectric window. A layer of foam or other biasing structures may be used to bias the antenna resonating element and carrier upwards against the interior surface of the cover glass.

A proximity sensor electrode or other conductive structure may be mounted within the housing under the carrier. The proximity sensor electrode may, for example, be mounted over a plastic antenna window. With this type of configuration, the distance between the proximity sensor electrode (or other such conductive structure) and the antenna resonating element may vary during manufacturing and use of the electronic device. For example, manufacturing variations and movement by a user during normal use may cause the foam that is used to bias the antenna resonating element and carrier upwards towards the cover glass to vary in thickness and thereby cause the separation between the antenna resonating element and the proximity sensor electrode to vary. Distance variations such as these have the potential to given rise to undesired antenna performance variations.

To address this source of possible antenna performance variations, conductive structures may be mounted to the underside of the carrier. Because the conductive structures are interposed between the antenna resonating element and the proximity sensor electrode, the conductive structures serve as an electromagnetic shield that tends to reduce the influence of the proximity sensor electrode on antenna performance. Incorporation of this shield into the antenna structures of device 10 therefore minimizes undesired performance variations in the antenna. The use of the carrier may also facilitate assembly and rework operations.

Antenna structures with configurations such as these can be mounted on any suitable exposed portion of a portable electronic device. For example, antennas can be provided on the front or top surface of the device. In a tablet computer, cellular telephone, or other device in which the front of the device is all or mostly occupied with conductive structures such as a touch screen display, it may be desirable to form at least part of the antenna window on a rear device surface. Other configurations are also possible (e.g., with antennas mounted in more confined locations, on device sidewalls, etc.). The use of antenna mounting locations in which at least part of a dielectric antenna window is formed in a conductive rear housing surface is sometimes described herein as an example, but, in general, any suitable antenna mounting location may be used in an electronic device if desired.

An illustrative portable device that may include antenna structures with carrier and shield structures is shown in FIG. 1. In general, devices such as device 10 of FIG. 1 may be any suitable electronic devices with wireless communications capabilities such as desktop computers, portable computers such as laptop computers and tablet computers, handheld electronic devices such as cellular telephones, smaller portable electronic devices such as wrist-watch devices, pendant devices, headphone devices, and earpiece devices, or other wearable or miniature devices.

As shown in FIG. 1, device 10 may be a relatively thin device such as a tablet computer. Device 10 may have display such as display 50 mounted on its front (top) surface. Housing 12 may have curved portions that form the edges of device 10 and a relatively planar portion that forms the rear surface of device 10 (as an example). Housings with straight sidewalls and other configurations may also be used. The front surface of device 10 (i.e., the cover of display 50) may sometimes be referred to as forming the front housing surface of device 12.

The cover of display 50 may be formed from a layer of cover glass, a layer of plastic, or other materials. The cover layer for display 50 may be radio transparent in its inactive edge region (i.e., away from the conductive portions of the display that include active pixel circuits). As a result, radio-frequency signals may be received by antenna structures that are mounted under an edge portion of the display cover layer and may be transmitted from the antenna structures through the edge portion of the display cover layer. In configurations in which housing 12 is formed form a metal or other conductive material, a dielectric window such as dielectric window 58 may be formed in housing 12. Antenna structures for device 10 may be formed in the vicinity of dielectric window 58, so that radio-frequency antenna signals can pass through dielectric window 58 (in addition to or instead of passing through the edge portions of the display cover layer).

Device 10 may have user input-output devices such as button 59. Display 50 may be a touch screen display that is used in gathering user touch input. Capacitive touch sensors or other touch sensors for the display may be implemented using a touch panel that is mounted under a planar cover glass member on the surface of display 50, may be integrated onto the cover glass layer, or may be otherwise incorporated into display 50.

The central portion of display 50 (shown as region 56 in FIG. 1) may be an active region that is sensitive to touch input and that is used in displaying images to a user using an array of image pixels (e.g., liquid crystal display image pixels, organic light-emitting diode image pixels, or other display pixels). The peripheral regions of display 50 such as regions 54 may be inactive regions that are free from touch sensor electrodes and image pixels. A layer of material such as an opaque ink may be placed on the underside of display 50 in peripheral regions 54 (e.g., on the underside of the cover glass). This layer may be transparent to radio-frequency signals. The conductive touch sensor electrodes in region 56 and the conductive structures associated with the array of image pixels in the display may tend to block radio-frequency signals. However, radio-frequency signals may pass through the cover glass and opaque ink in inactive display regions 54 (as an example). Radio-frequency signals may also pass through antenna window 58.

Housing 12 may be formed from one or more structures. For example, housing 12 may include an internal frame and planar housing walls that are mounted to the frame. Housing 12 may also be formed from a unitary block of material such as a cast or machined block of aluminum. Arrangements that use both of these approaches may also be used if desired.

Housing 12 may be formed of any suitable materials including plastic, wood, glass, ceramics, metal, or other suitable materials, or a combination of these materials. In some situations, portions of housing 12 may be formed from a dielectric or other low-conductivity material, so as not to disturb the operation of conductive antenna elements that are located in proximity to housing 12. In other situations, housing 12 may be formed from metal elements. An advantage of forming housing 12 from metal or other structurally sound conductive materials is that this may improve device aesthetics and may help improve durability and portability.

With one suitable arrangement, housing 12 may be formed from a metal such as aluminum or stainless steel. Portions of housing 12 in the vicinity of antenna window 58 may serve as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved surface.

Figure 2:
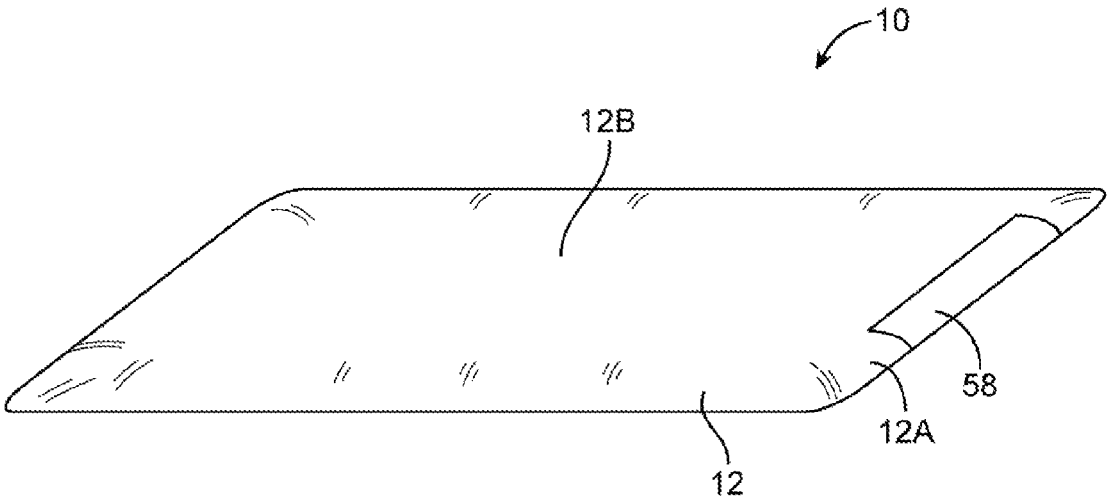
FIG. 2 is a rear perspective view of an illustrative electronic device with an antenna having a dielectric carrier and a shield in accordance with an embodiment of the present invention.

FIG. 2 is a rear perspective view of device 10 of FIG. 1 showing how device 10 may have a relatively planar rear surface 12B and showing how dielectric antenna window 58 may be rectangular in shape with curved portions that match the shape of curved housing edges 12A (as an example).

Figure 3:
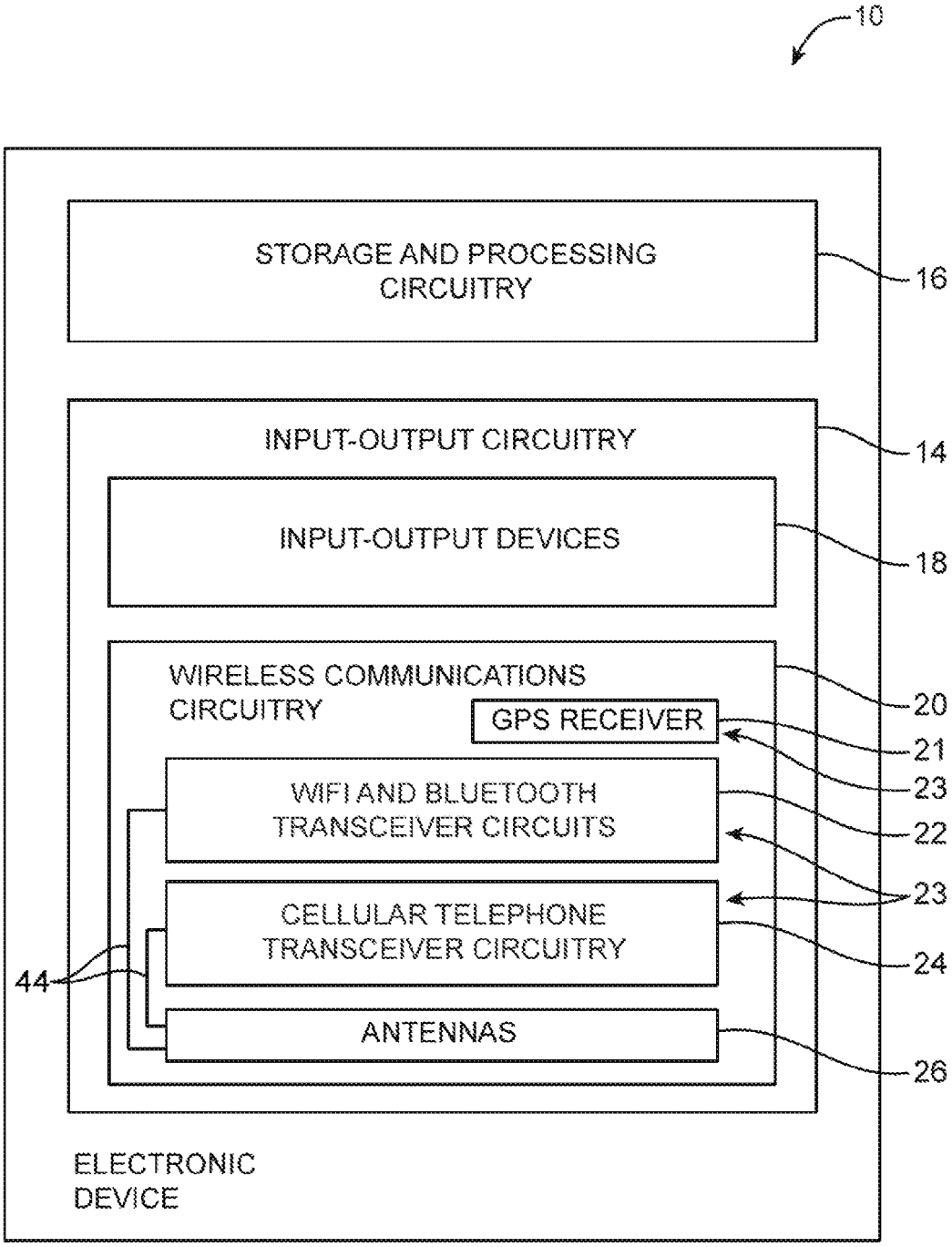
FIG. 3 is a schematic diagram of an illustrative electronic device with antenna structures in accordance with an embodiment of the present invention.

A schematic diagram of device 10 showing how device 10 may include one or more antennas 26 and transceiver circuits that communicate with antennas 26 is shown in FIG. 3. As shown in FIG. 3, electronic device 10 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 16 may be used to control the operation of device 10. Processing circuitry 16 may be based on a processor such as a microprocessor and other suitable integrated circuits. With one suitable arrangement, storage and processing circuitry 16 may be used to run software on device 10, such as internet browsing applications, voice-over-internet-protocol (VOIP) telephone call applications, email applications, media playback applications, operating system functions, control functions for controlling radio-frequency power amplifiers and other radio-frequency transceiver circuitry, etc. Storage and processing circuitry 16 may be used in implementing suitable communications protocols. Communications protocols that may be implemented using storage and processing circuitry 16 include internet protocols, cellular telephone protocols, wireless local area network protocols (e.g., IEEE 802.11 protocols—sometimes referred to as WiFi®), protocols for other short-range wireless communications links such as the Bluetooth® protocol, etc.

Input-output circuitry 14 may be used to allow data to be supplied to device 10 and to allow data to be provided from device 10 to external devices. Input-output devices 18 such as touch screens and other user input interface are examples of input-output circuitry 14. Input-output devices 18 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices may be included in devices 18 such as liquid-crystal display (LCD) screens, light-emitting diodes (LEDs), organic light-emitting diodes (OLEDs), and other components that present visual information and status data. Display and audio components in input-output devices 18 may also include audio equipment such as speakers and other devices for creating sound. If desired, input-output devices 18 may contain audio-video interface equipment such as jacks and other connectors for external headphones and monitors.

Wireless communications circuitry 20 may include radio-frequency (RF) transceiver circuitry 23 formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 20 may include radio-frequency transceiver circuits for handling multiple radio-frequency communications bands. For example, circuitry 20 may include transceiver circuitry 22 that handles 2.4 GHz and 5 GHz bands for WiFi (IEEE 802.11) communications and the 2.4 GHz Bluetooth communications band. Circuitry 20 may also include cellular telephone transceiver circuitry 24 for handling wireless communications in cellular telephone bands such as the bands at 850 MHz, 900 MHz, 1800 MHz, and 1900 MHz, and 2100 MHz band (as examples). Wireless communications circuitry 20 can include circuitry for other short-range and long-range wireless links if desired. For example, wireless communications circuitry 20 may include global positioning system (GPS) receiver equipment 21, wireless circuitry for receiving radio and television signals, paging circuits, etc. In WiFi and Bluetooth links and other short-range wireless links, wireless signals are typically used to convey data over tens or hundreds of feet. In cellular telephone links and other long-range links, wireless signals are typically used to convey data over thousands of feet or miles.

Wireless communications circuitry 20 may include antennas 26 such as an antenna or antennas located adjacent to antenna window 58 and under the inactive peripheral portion 54 of display 50. Antennas 26 may be single band antennas that each cover a particular desired communications band or may be multiband antennas. A multiband antenna may be used, for example, to cover multiple cellular telephone communications bands. If desired, a dual band antenna may be used to cover two WiFi bands (e.g., 2.4 GHz and 5 GHz). A single band antenna may be used to receive Global Positioning System signals at 1575 MHz (as an example). Different types of antennas may be used for different bands and combinations of bands. For example, it may be desirable to form a dual band antenna for forming a local wireless link antenna, a multiband antenna for handling cellular telephone communications bands, and a single band antenna for forming a global positioning system antenna (as examples).

Transmission line paths 44 may be used to convey radio-frequency signals between transceivers 23 and antennas 26. Radio-frequency transceivers such as radio-frequency transceivers 23 may be implemented using one or more integrated circuits and associated components (e.g., switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 44 may be used to interconnect the transceiver integrated circuits and other components on the printed circuit board with antenna structures in device 10. Paths 44 may include any suitable conductive pathways over which radio-frequency signals may be conveyed including transmission line path structures such as coaxial cables, microstrip transmission lines, etc.

Antennas 26 may, in general, be formed using any suitable antenna types. Examples of suitable antenna types for antennas 26 include antennas with resonating elements that are formed from patch antenna structures, inverted-F antenna structures, closed and open slot antenna structures, loop antenna structures, monopoles, dipoles, planar inverted-F antenna structures, hybrids of these designs, etc. With one suitable arrangement, which is sometimes described herein as an example, part of housing 12 (e.g., the portion of housing 12 in the vicinity of antenna window 58) may form a ground structure for the antenna associated with window 58. Antenna ground structures may also be formed from conductive traces on printed circuit boards, internal housing members such as frame members and structural internal housing plates, conductive portions of components such as connectors, and other conductive structures.

Figure 4:
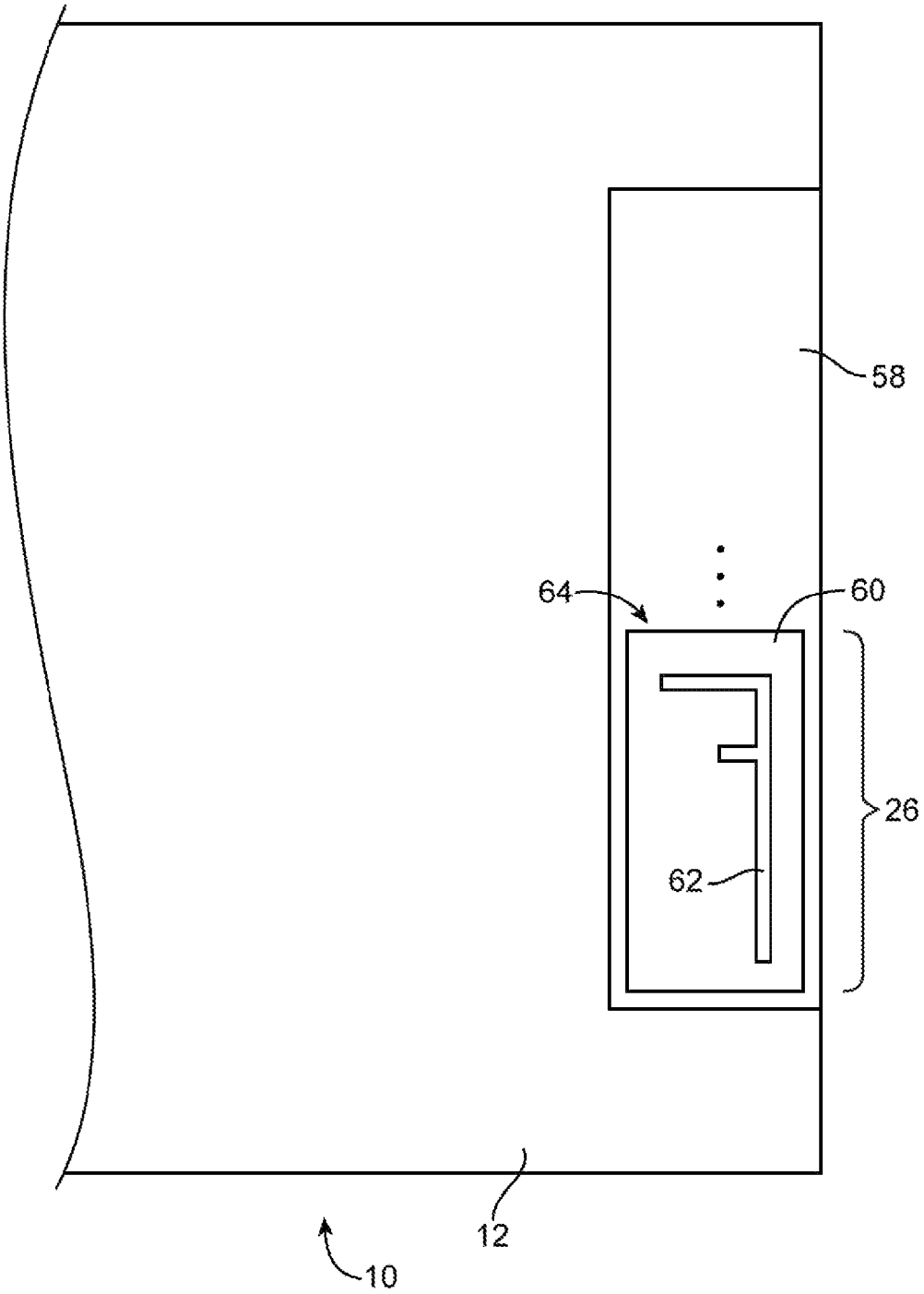
FIG. 4 is a rear view of an illustrative electronic device having an antenna with a dielectric carrier structure and a conductive shielding structure in accordance with an embodiment of the present invention.

A rear view of electronic device 10 in the vicinity of dielectric window 58 is shown in FIG. 4. The antennas in device 10 may each include an antenna resonating element and an antenna ground. For example, antenna 26 of FIG. 4 may be formed from antenna resonating element 64 and nearby conductive structures such as portions of housing 12 that serve as antenna ground. Antenna resonating elements such as antenna resonating element 64 may overlap with antenna window 58.

As shown in FIG. 4, antenna window 58 may extend along an edge of housing 12 in device 10 and may be large enough to accommodate one or more antennas 26, each of which may include a corresponding antenna resonating element 64.

Antenna resonating elements such as antenna resonating element 64 of FIG. 4 may include conductive structures 62. Conductive structures 62 may be formed from strips of metal, wires, portions of conductive housing members, or other conductive structures. With one suitable arrangement, which is sometimes described herein as an example, conductive structures 62 are formed from patterned conductive traces on a dielectric substrate such as substrate 60.

Antenna resonating element substrate 60 may be formed from molded plastic, rigid printed circuit board layers (e.g., layers of fiber-glass-filled epoxy), flexible printed circuit board layers, etc. Flexible printed circuits (sometimes referred to a flex circuits) may be formed from flexible sheets of polymer such as polyimide. Conductive traces 62 may be formed on an antenna resonating element substrate layer to form a desired conductive pattern for an antenna resonating element. As shown in FIG. 4, for example, patterned conductive traces 62 may be formed in an inverted-F shape on substrate 60 (e.g., on a flex circuit substrate). Traces 62 may be formed from copper, gold, other metals, or combinations of these metals.

Figure 5:
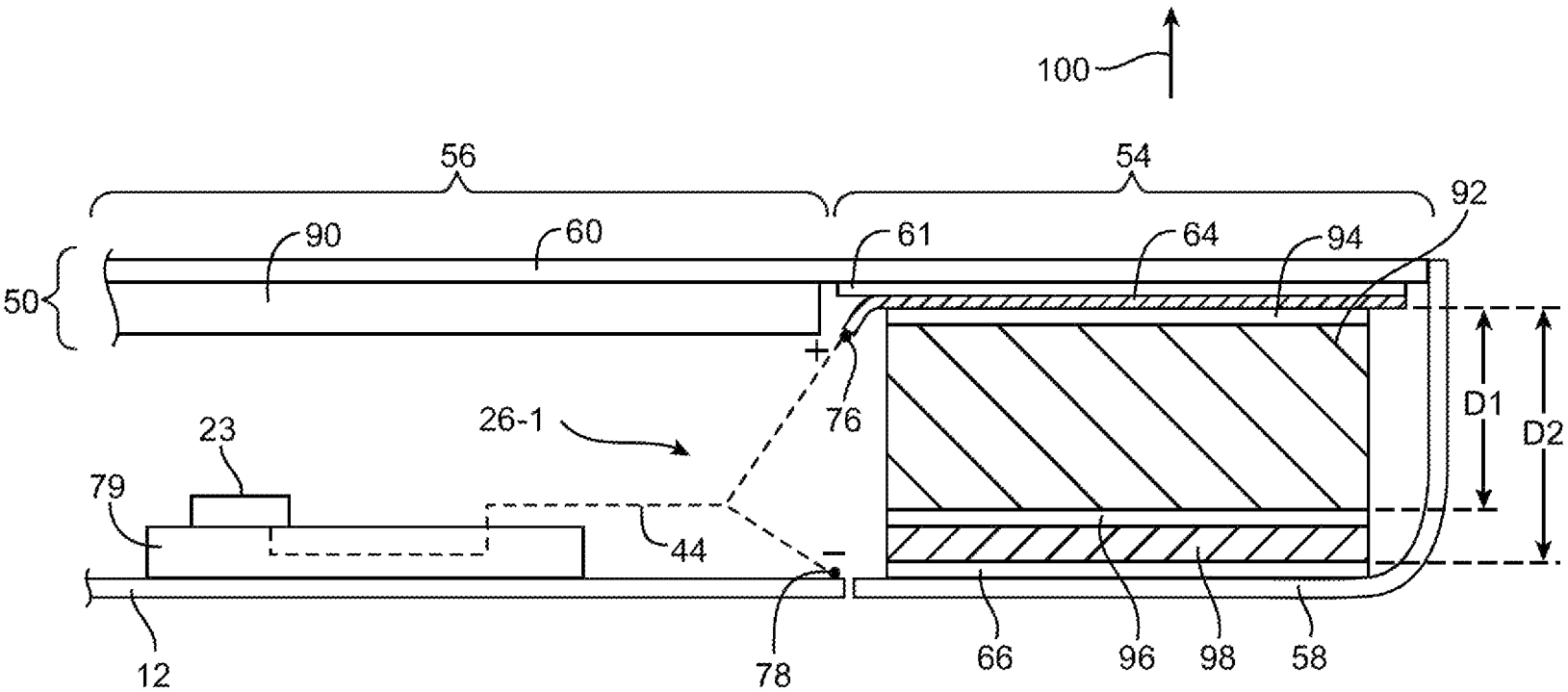
FIG. 5 is a cross-sectional side view of an illustrative electronic device having a proximity sensor electrode and having an antenna with a shield structure that interposed between the proximity sensor and an antenna resonating element in accordance with an embodiment of the present invention.

A cross-sectional side view of housing 12 showing how antenna resonating element 64 may be mounted under the surface of cover glass layer 60 is shown in FIG. 5. As shown in FIG. 5, antenna 26 may include antenna resonating element 64 and an antenna ground formed from conductive portions of housing 12 or other conductive structures. Antenna 26 may be fed using a feed terminal that is coupled to antenna resonating element 64 such as positive antenna feed terminal 76 and a ground antenna feed terminal that is coupled to housing 12 such as ground antenna feed terminal 78. Transmission lines 44 may couple feed terminals 76 and 78 to radio-frequency transceiver circuitry 23 on printed circuit board 79.

Antenna resonating element 64 may be placed in the vicinity of dielectric antenna window 58, so that radio-frequency signals can be conveyed through window 58. Radio-frequency signals can also be conveyed through a display cover member such as cover glass 60. Display 50 may have an active region such as region 56 in which cover glass 60 has underlying conductive structure such as display panel module 90. The structures in display panel 90 such as touch sensor electrodes and active display pixel circuitry may be conductive and may therefore attenuate radio-frequency signals. In region 54, however, display 50 may be inactive (i.e., module 90 may be absent). An opaque layer such as opaque ink 61 may be formed on the underside of transparent cover glass 60 in region 54 to block antenna resonating element 68 from view. Ink 61 and the dielectric material of cover member 60 in region 54 may be sufficiently transparent to radio-frequency signals that radio-frequency signals can be conveyed through these structures during operation of device 10.

Conductive structures such as conductive structures 66 may be located under antenna resonating element 64. Conductive structures 66 may be, for example, one or more capacitor electrodes for a proximity sensor. These electrode structures may be formed from patterned metal traces on a flex circuit or other suitable substrate. As shown in FIG. 5, antenna resonating element 64 may be mounted on a support structure such as carrier 92. Carrier 92 may be formed form a dielectric material such as plastic. Cavities may be formed in the plastic to facilitate fabrication using plastic molding equipment and to help lower the effective dielectric constant of carrier 92. Although shown as having a rectangular cross section, carrier 92 may, if desired, have a cross-sectional shape with curved edges, a shape with non-parallel edges, or other suitable shape. In the dimension that extends along the edge of housing 12 (i.e., along the length of dielectric window 58 of FIG. 4), carrier 92 may have straight edges (as an example).

Antenna resonating element substrate 60 of antenna resonating element 64 may be mounted to the upper surface of carrier 92 using adhesive 94 (as an example). A biasing structure such as one or more strips of elastomeric foam 98 may be formed under carrier 92. Foam 98, springs, or other suitable biasing structures may be used to press antenna resonating element 64 upwards in direction 100 against the lower surface of cover glass 60.

Due to the close proximity between antenna resonating element 64 and conductive structures 66, conductive structures 66 may serve as a parasitic antenna resonating element that influences the performance of antenna 26. Due to manufacturing variations such as variations in the size of housing 12, display 50, and dielectric window 58, there may be inherent variation in the distance D2 between antenna resonating element 64 and conductive structures 66. Variations in distance D2 have the potential to lead to undesirable variations in the performance of antenna 26.

To eliminate or at least reduce the influence of variations in the distance D2 on the performance of antenna 26, conductive shielding structures may be interposed between antenna resonating element 64 and conductive structures 66. For example, a shield such as shield 96 may be formed on the lower surface of carrier 96. Shield 96 may be formed from conductive materials such as metals. For example, shield 96 may be formed from a layer of aluminum or copper tape that is attached to carrier 92 with adhesive. Shield 96 may be electrically isolated from other structures in device 10 such as ground structures. This allows the thickness of carrier 92 to be minimized without unnecessarily restricting the bandwidth of antenna 26.

Shield 96 serves to shield antenna resonating element 64 from conductive structures 66 and vice versa. The electromagnetic influence of conductive structures 66 is therefore effectively blocked by the presence of shield 96, particularly when shield 96 has an area that is substantially equal to or larger than the area of structures 66. As a result, conductive structures 66 have little or no influence on the performance of antenna 26 and variations in the distance D2 between conductive structures 66 and antenna resonating element 64 do not significantly affect antenna performance. This reduces the susceptibility of antenna 26 to manufacturing variations.

The presence of shield 96 tends to influence the performance of antenna 26 (i.e., shield 96 serves as a parasitic antenna resonating element). Nevertheless, the distance D1 between shield 96 and antenna resonating element 64 is fixed by the fixed thickness of carrier 92. Although foam 98 may flex and manufacturing variations in display 50, housing 12, and antenna window 58 may give rise to variations in distance D2 between conductive structures 66 and antenna resonating element 64, the fixed thickness of carrier 92 fixes the distance D1 between antenna resonating element 64 and shield 96. Because distance D1 is fixed and because the close proximity between shield 96 and antenna resonating element 64 causes shield 96 to be the dominant influence on the performance of antenna 26, arrangements of the type shown in FIG. 5 may help make antenna 26 resistant to undesired performance fluctuations.

Conductive structures 66 may be associated with conductive components (e.g., conductive electronic device components such as cameras, speakers, microphones, switches, connectors, sensors, light-emitting diodes, display components, etc.), portions of a device housing, or other conductive materials (e.g., other conductive structures that are electrically isolated from conductive housing 12). With one suitable arrangement, conductive structures 66 may be used in forming capacitor electrodes for a proximity sensor.

Figure 6:
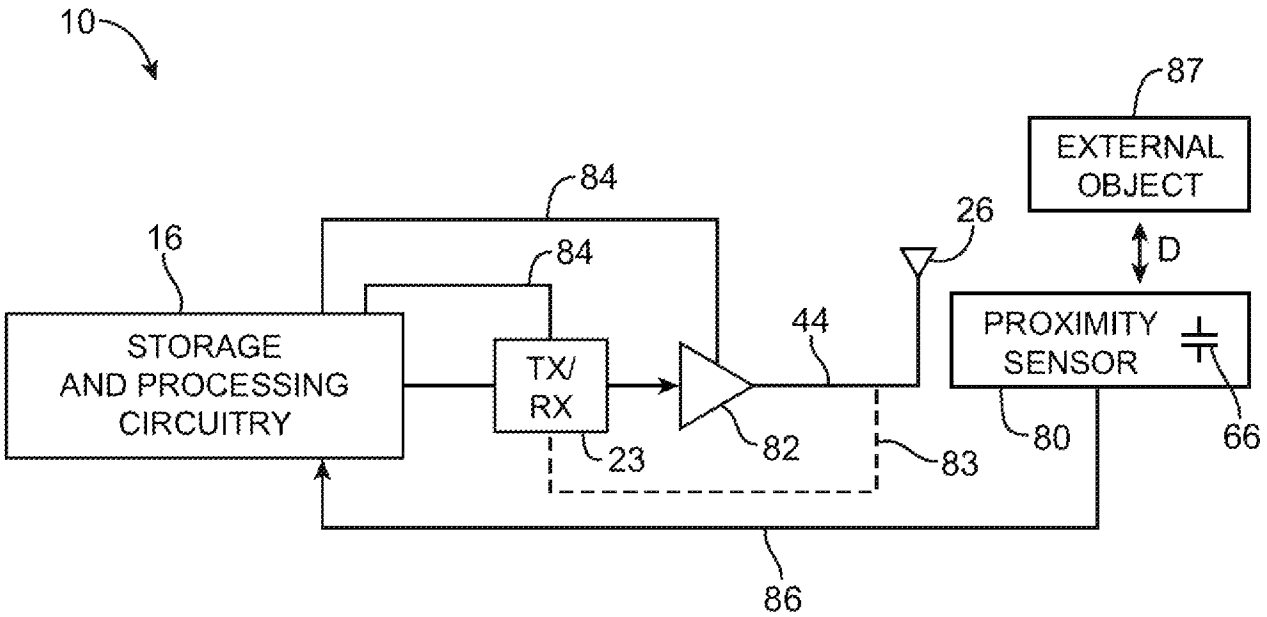
FIG. 6 is a diagram of an illustrative electronic device having an antenna and wireless circuitry that may reduce the amount of power transmitted through the antenna when a proximity sensor detects that an external object is within a given range of the antenna and the electronic device in accordance with an embodiment of the present invention.

A circuit diagram showing how a proximity sensor signal may be used in controlling the amount of power that is transmitted by antenna 26 is shown in FIG. 6. As shown in FIG. 6, device 10 may include storage and processing circuitry 16 (see, e.g., FIG. 3). Device 10 may also include a proximity sensor such as proximity sensor 80. Proximity sensor 80 may be implemented using any suitable type of proximity sensor technology (e.g., capacitive, optical, etc.). An advantage of capacitive proximity sensing techniques is that they can be relatively insensitive to changes in the reflectivity of external object 87.

As shown in the example of FIG. 6, proximity sensor 80 may contain a capacitor electrode formed from a conductive member such as conductive member 66 (FIG. 5).

Proximity sensor 80 may be mounted in housing 12 in the vicinity of antenna 26 (as shown in FIG. 5) to ensure that the signal from proximity sensor 80 is representative of the presence of external object 87 in the vicinity of antenna 26 (e.g., within a distance D of antenna 26 and/or device 10).

Output signals from proximity sensor 80 may be conveyed to storage and processing circuitry 16 using path 86. The signals from proximity sensor 80 may be analog or digital signals that provide proximity data to storage and processing circuitry 16. The proximity data may be Boolean data indicating that object 87 is or is not within a given predetermined distance of antenna 26 or may be continuous data representing a current estimated distance value for D.

Storage and processing circuitry 16 may be coupled to transceiver circuitry 23 and power amplifier circuitry 82. Dashed line 83 shows how received radio-frequency signals can be conveyed from antenna 26 to transceiver circuitry 23. During data transmission operations, control lines 84 may be used to convey control signals from storage and processing circuitry 16 to transceiver circuitry 23 and power amplifier circuitry 82 to adjust output powers in real time. For example, when data is being transmitted, transceiver 23 and is associated output amplifier 82 can be directed to increase or decrease the power level of the radio-frequency signal that is being provided to antenna 26 over transmission line 44 to ensure that regulatory limits for electromagnetic radiation emission are satisfied. If, for example, proximity sensor 80 does not detect the presence of external object 87, power can be provided at a relatively high (unrestricted) level. If, however, proximity sensor 80 determines that a user's leg or other body part or other external object 87 is in the immediate vicinity of antenna 26 (e.g., within 20 mm or less, within 15 mm or less, within 10 mm or less, etc.), storage and processing circuitry can respond accordingly by directing transceiver circuitry 23 and/or power amplifier 82 to transmit radio-frequency signals through antenna 26 at reduced powers.

The foregoing is merely illustrative of the principles of this invention and various modifications can be made by those skilled in the art without departing from the scope and spirit of the invention.

What is claimed is:

1. An electronic device, comprising:

conductive antenna ground structures;

a display having a planar cover layer;

an antenna resonating element adjacent to the planar cover layer, wherein the conductive antenna ground structures and the antenna resonating element form an antenna for the electronic device;

conductive structures that are electrically isolated from the conductive antenna ground structures; and a planar conductive shield that is interposed between the antenna resonating element and the conductive structures and that shields the antenna resonating element from the conductive structures; and an opaque layer interposed between the antenna resonating element and the planar cover layer.

2. The electronic device defined in claim 1 further comprising a dielectric member interposed between the antenna resonating element and the planar conductive shield.

3. The electronic device defined in claim 2 further comprising a biasing structure that biases the dielectric member and the antenna resonating element towards the planar cover layer.

4. The electronic device defined in claim 3 wherein the biasing structure comprises foam and wherein the planar cover layer comprises a planar layer of display cover glass.

5. The electronic device defined in claim 4 wherein the conductive antenna ground structures comprise portions of a conductive housing for the electronic device.

6. The electronic device defined in claim 5 further comprising a dielectric window in the conductive housing.

7. The electronic device defined in claim 6 further comprising foam that is interposed between the dielectric window and the planar conductive shield.

8. The electronic device defined in claim 2 wherein the dielectric member comprises a plastic carrier.

9. The electronic device defined in claim 8 wherein the antenna resonating element is attached to the plastic carrier with adhesive.

10. The electronic device defined in claim 9 wherein the conductive antenna ground structures comprise portions of a conductive housing for the electronic device.

11. The electronic device defined in claim 10 further comprising a dielectric window in the conductive housing.

12. The electronic device defined in claim 11 wherein foam is interposed between the dielectric window and the planar conductive shield.

13. The electronic device defined in claim 12 wherein the conductive shield comprises metal tape.

14. The electronic device defined in claim 12 wherein the conductive structures comprise a proximity sensor electrode on the dielectric window.

15. The electronic device defined in claim 2, wherein the antenna resonating element is mounted on a first surface of the dielectric member and wherein the planar conductive shield is mounted on a second surface of the dielectric member.

16. The electronic device defined in claim 1 wherein the conductive antenna ground structures include at least part of a tablet computer housing.

17. The electronic device defined in claim 1, wherein the planar conductive shield is electrically isolated from the conductive antenna ground structures.

18. The electronic device defined in claim 1 wherein the conductive structures comprise a proximity sensor electrode.

19. The electronic device defined in claim 18, further comprising foam interposed between the proximity sensor electrode and the planar conductive shield.

20. The electronic device defined in claim 1, wherein the opaque layer comprises an opaque ink layer.

* * * * *